US009482238B2

(12) United States Patent
Korupp et al.

(10) Patent No.: US 9,482,238 B2
(45) Date of Patent: Nov. 1, 2016

(54) PUMP AND PROTECTOR FOR PUMP

(71) Applicant: Herborner Pumpenfabrik J.H. Hoffmann GmbH & Co. KG, Herborn (DE)

(72) Inventors: Sascha Korupp, Werdorf (DE); Lars Runte, Dillenburg-Frohnhausen (DE); Felix Hees, Glessen (DE)

(73) Assignee: Herborner Pumpentechnik GmbH & Co. KG, Herborn (DE)

( * ) Notice: Subject to any disclaimer, the term of this patent is extended or adjusted under 35 U.S.C. 154(b) by 466 days.

(21) Appl. No.: 14/020,955

(22) Filed: Sep. 9, 2013

(65) Prior Publication Data

US 2014/0072409 A1 Mar. 13, 2014

(30) Foreign Application Priority Data

Sep. 7, 2012 (DE) ..... 10 2012 108 354

(51) Int. Cl.
*F04D 29/12* (2006.01)
*F04D 29/02* (2006.01)

(52) U.S. Cl.
CPC ..... *F04D 29/12* (2013.01); *F04D 29/026* (2013.01); *F04D 29/126* (2013.01); *F05D 2260/95* (2013.01); *F05D 2300/111* (2013.01); *Y10T 16/05* (2015.01)

(58) Field of Classification Search
CPC .... F04D 29/026; F04D 29/12; F04D 29/126; Y10T 16/05
See application file for complete search history.

(56) References Cited

U.S. PATENT DOCUMENTS 3,551,067 A * 12/1970 Wissman ..... F04D 7/02 415/134
3,652,183 A * 3/1972 Pottharst, Jr. ..... F04D 29/102 277/373
3,841,791 A * 10/1974 Doolin ..... F04D 29/426 415/143
3,973,867 A * 8/1976 Lee ..... F04D 5/002 415/143
4,415,165 A * 11/1983 Martini ..... F16J 15/008 277/379
4,421,456 A * 12/1983 Huffman ..... F04D 29/126 415/170.1
4,655,684 A * 4/1987 Haentjens ..... F04D 29/126 415/170.1
4,722,664 A 2/1988 Wissman

FOREIGN PATENT DOCUMENTS

| | | |
|---|---|---|
| DE | 20 01 267 | 1/1975 |
| DE | 44 44 968 | 6/1996 |
| DE | 297 23 409 | 9/1998 |
| DE | 198 05 152 | 11/1999 |
| DE | 200 22 573 | 11/2001 |

* cited by examiner

*Primary Examiner* — Igor Kershteyn
(74) *Attorney, Agent, or Firm* — Clark & Brody

(57) ABSTRACT

The invention relates to a pump, in particular a centrifugal pump (1), with a pump housing (2), wherein a motor shaft (5), which is connected to a pump impeller (6) arranged in the pump housing (2), extends through a shaft passage (4) in a rear wall (3) of the pump housing (2) and is mounted in the rear wall (3) by a mechanical seal arrangement (8).

19 Claims, 3 Drawing Sheets

PUMP AND PROTECTOR FOR PUMP

FIELD OF THE INVENTION

The invention relates to a pump, in particular a centrifugal pump, according to the. The invention further relates to a protector.

BACKGROUND ART

Pumps and in particular centrifugal pumps are used for pumping pump media, in particular fluids, which enter the pump through a suction pipe and are dispensed by the pump through a pressure pipe. For this purpose, a pump impeller with which the fluid is pumped is arranged within the pump housing. A motor shaft that is connected to the pump impeller is fed outward through the rear wall of the pump housing and can be connected to a motor which, for example, is fastened on the rear wall of the pump.

Such pumps are often also used for pumping corrosive media. For example, they are used for circulating chlorinated swimming pool water. Accordingly, the pumps have to be produced from a corrosion-resistant material or, e.g., have to be protected from direct contact with the pump medium by means of a corrosion-resistant coating.

Corrosion-resistant materials such as, for example, bronze are relatively expensive and difficult to process so that the pumps or pump housings made from such a material are relatively cost-intensive. In contrast, pumps having a coated pump housing can be produced from lower-cost materials such as, for example, gray cast iron, and by using lower-cost production methods.

However, it was found that it is problematic to form a closed corrosion-resistant coating within the shaft passage. In the shaft passage, the seal seat of the mechanical seal arrangement is formed which generally is formed integrally with pump housing. For secure sealing, the mechanical seal seat has to be fabricated in a precisely fitting manner. However, by applying a coating, the required accuracy of fit cannot be ensured.

The consequence of this is that in conventional pumps, the coating is interrupted at least in the region of the seal seat of the mechanical seal arrangement. However, because of this, the seal seat does not represent a rust-proof design. After disassembling the rear wall, for example due to maintenance or repair work, it is often difficult or not possible at all, due to corrosion on the seal seat, to insert a new sealing ring of the mechanical seal arrangement. Hereby, leaks can occur between the seal seat and the new sealing ring. Normally, this results in repair work.

SUMMARY OF THE INVENTION

It is now an object of the invention to eliminate the disadvantages of the prior art and to provide a solution by means of which full corrosion protection for the pump housing can be achieved. At the same time, this solution shall be cost-effective and implementable with low production efforts, and shall enable a long service life.

Thus, a seal seat of the mechanical seal arrangement is formed in a ring-shaped protector made from a corrosion-resistant material, which protector is fixedly arranged in the shaft passage in the rear wall. Independent of the material used for the pump and the production method used, the protector with the seal seat can be made from a corrosion-resistant material in a very precisely fitting manner and can be inserted in the shaft passage of the rear wall. This ensures that the seal seat of the mechanical seal arrangement is corrosion-resistant and has the required accuracy of fit. In this manner, the required tightness is also ensured after replacing a seal of the mechanical seal arrangement. There is no concern for rusting of the seal seat so that the mechanical seal arrangement can be disassembled even after many years of use of corrosive pump media in the pump, and it can be replaced as needed. Thus, this results in a long service life of the pump. A contact area of the rear wall with the protector is then also protected against corrosion by the protector.

It is particularly preferred here that the pump housing is designed as a casting, in particular as a gray iron casting. Such a pump housing can be produced in a cost-effective manner.

In order to protect the pump housing from contact with the pump medium and thus from corrosion, the pump housing can comprise a corrosion-resistant coating, wherein the coating also covers a transition between the rear wall and the protector. In this manner it is possible to seal all pump housing areas that come into contact with the fluid, wherein at the same time, the connection between the protector and the rear wall is additionally sealed by the coating. Since the protector is formed from a corrosion-resistant material, no coating is required in the region of the seal seat. There, the rear wall of the pump is protected by the protector. All other regions that come into contact with pump medium, in particular the pump housing itself, are then shielded by the coating. Because of this, the pump can be used without any problems under corrosion-promoting conditions, for example in swimming pools.

In a preferred configuration, the protector has an radially outward facing, circumferential support flange which is arranged on a front side that faces toward the pump impeller and by means of which the protector is supported on the rear wall in an axial direction. The axial direction corresponds here to a longitudinal extent of the shaft. The protector that extends from an inside of the rear wall up to the outside of the rear wall, and is radially held in the shaft passage, is preferably flush on the outside with the rear wall. The protector rests with its support flange against the inside of the rear wall. Thus, the flange is fixed in its axial position. At the same time, it is possible without any problems to also extend a coating over the support flange of the protector so that a transition between the rear wall and the support flange and/or the protector is covered by the coating. Due to the radial extent of the support flange, a sufficiently large contact area is available for coating. Thus, secure adherence of the coating on the protector is ensured.

On an inside, the rear wall can comprise a stepped support region for the support flange that extends farther in the radial direction than the support flange. This results in advantageous flow conditions. Furthermore, on the one hand, it is achieved that the support flange does not protrude or only slightly protrudes with respect to the rear wall in the axial direction. On the other hand, in that the support region extends farther in the radial direction than the support flange, a gap is formed which surrounds the support flange in a ring-shaped manner and which can be filled up by the coating. Thus, in the region of transition between the pump housing and the protector, which region is particularly critical, a thicker coating layer is obtained, and thus the certainty is increased that a complete coating is achieved. In addition, geometrical over determinacy is avoided and therefore producing with wider tolerances is made possible.

To compensate tolerances, an inner border of the shaft passage can be chamfered. For this, an edge of the shaft passage is beveled or rounded, for example. This makes it easier to insert the protector into the pump housing.

Preferably, the seal seat is formed by a radially inward protruding circumferential collar on the front side of the protector, which front side faces away from the pump impeller. When the protector is assembled, the seal seat is then located approximately in the region of the outside of the rear wall. Then, sufficient space is available within the shaft passage or within the protector for the mechanical seal arrangement so that an axial installation length can be kept short. Furthermore, as a result, guidance of the motor shaft within the protector and therefore relatively high stability is achieved.

The mechanical seal arrangement can comprise a sealing ring and a counter ring with a counter sealing ring seat, wherein the counter ring is connected to the shaft in a rotationally fixed manner, and the sealing ring is arranged between the seal seat and the counter sealing ring seat. The counter ring can be supported in the protector in the radial direction in such a manner that it is guided in an axially movable manner. Thereby, a relatively high overall stiffness is obtained. The interaction between the counter ring and the sealing ring results in a reliable sealing of the shaft in the shaft passage and therefore of the interior of the pump housing, which sealing withstands high loads such as, for example, high speeds and pressures.

The protector can be pressed into the shaft passage or can be glued therein, or can be held in the shaft passage via mating threads. For this purpose, for example, the protector can be slightly oversized with respect to the shaft passage so that a press fit is obtained through which the protector is held in the pump housing or in the shaft passage by means of traction. Thus, on the one hand, tolerances can be compensated relatively easily and, on the other, an absolutely tight and play-free connection between the protector and the pump housing is ensured. If replacing the protector has to be possible, mating threads are a suitable solution for detachably fastening the protector in the shaft passage. By means of the coating, which covers the transition between the protector and the rear wall, penetrating of fluids between the protector and the rear wall is then also prevented in the case of mating threads, and therefore high tightness and corrosion resistance are ensured.

In a preferred configuration, the protector comprises a bronze material. Bronze can be easily processed and ensures high resistance against pump media that are usually pumped such as, for example, swimming pool water.

The object is also achieved by a protector for a pump which is formed in a ring-shaped manner from a corrosion-resistant material, in particular a bronze material, and which has a radially outward projecting supporting flange on a first front side, and on a second front side, the protector has a radially inward projecting collar that forms a seal seat. Thus, the protector represents an additional element by means of which a seal seat can be introduced in the shaft passage of a pump housing. The protector protects the material of the pump housing against the pumped fluid and thus enables the use of coated pump housings. At the same time, the required accuracy of fit of the seal seat is achieved by the protector since the protector itself has sufficient corrosion resistance even without coating. Thus, the protector provides a secure solution for implementing a seal seat in a coated pump housing, wherein in the region of the shaft passage, the pump housing is protected by the protector against corrosion and, accordingly, no coating is required there. The axial position of the protector in a rear wall is defined by the outwardly projecting support flange.

BRIEF DESCRIPTION OF THE DRAWINGS

Further features, details and advantages of the invention arise from the following description of exemplary embodiments based on the drawings. In the figures.

DETAILED DESCRIPTION OF THE INVENTION

Figure 1:
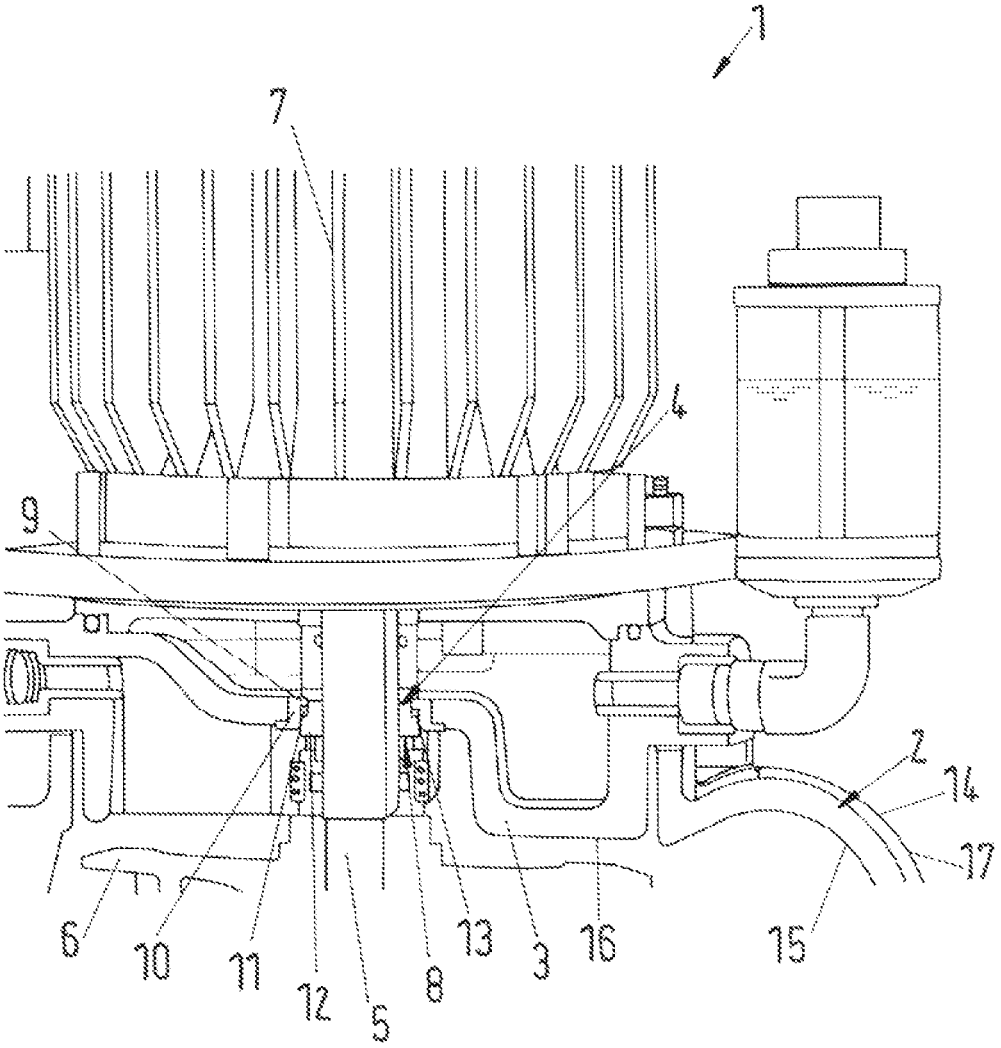
FIG. 1 shows a cut-out of a centrifugal pump in a partially cut spatial illustration.

FIG. 1 shows a partially cut spatial illustration of a pump designed as a centrifugal pump 1. The centrifugal pump 1 comprises a pump housing 2 with a rear wall 3 that has a shaft passage 4 through which a motor shaft 5 is guided. A pump impeller 6 arranged inside the pump housing 2 is connected to a motor 7 in a rotationally fixed manner via the motor shaft 5. The motor 7 is fastened to the rear wall 3 of the pump housing 2.

The motor shaft 5 is mounted in the rear wall 3 and/or in the shaft passage 4 by means of a mechanical seal arrangement 8. A seal seat 9 of the mechanical seal arrangement 8 is formed in a protector 10 which is secured in the shaft passage 4 in a friction-locked manner by means of a press fit. In addition to the seal seat 9, the mechanical seat arrangement 8 comprises a sealing ring 11 and a counter ring 12 which is connected to the motor shaft 5 in a rotationally fixed manner and has a counter sealing ring seat 13. The counter sealing ring seat 13 interacts with seal seat 9 via the sealing ring 11 so that a fluid-tight pivot bearing is obtained.

The pump house 2 and the rear wall 3 are provided on an outside 14 and an inside 15 with a corrosive coating 16, 17 which protects those regions of the pump housing 2 against corrosion which come into contact with the pump medium. In this exemplary embodiment, the pump housing 2 is designed as a gray iron casting, thus from a material which as such has no sufficient corrosion resistance. However, due to the coating 16, 17, the pump 1 can be used for corrosive fluids without any problems.

The protector 10 rests with a support flange 18 against the inside 15 of the rear wall 3. For this, a stepped support region is formed in the rear wall 3 (FIG. 2), which support region extends farther in the radial direction than the support flange 18. The coating 16, which is applied in the shaft passage after the protector is inserted, also extends over the support flange 19 and thus covers a transition between the protector 10 and the rear wall 3. This results in a greater material thickness of the coating 16 in the region of the transition 20 so that a reliable corrosion protection is ensured. A contact area between the protector 10 and the pump housing 2 remains uncoated and, accordingly, can have a high accuracy of fit. The required corrosion protection is provided by the protector that shields the contact area from fluids.

On a radial inside, and in particular in the region of the seal seat 9, the protector 10, which is made from a corrosion-resistant material such as, for example, bronze, has no coating. Thus, the seal seat 9 can also be manufactured with high accuracy of fit so as to ensure a reliable sealing. Due to the material of the protector, there is no concern for corrosion of the seal seat 9, not even over a long operation period.

The seal seat 9 is formed on a radially inward projecting collar 21 of the protector 10. The collar is located at a front side 22 of the protector 10, which front side faces toward the outside 14 of the rear wall 3 and is approximately flush with the rear wall. The support flange 18 is located on the opposite front side 23 that faces toward the inside 15 and/or the pump impeller 6. By such a design, the counter ring 12 of the mechanical seal arrangement 8 can also be radially guided within the protector 10 so that a stable guidance of the motor shaft and a large sealing area are obtained.

Figure 2:
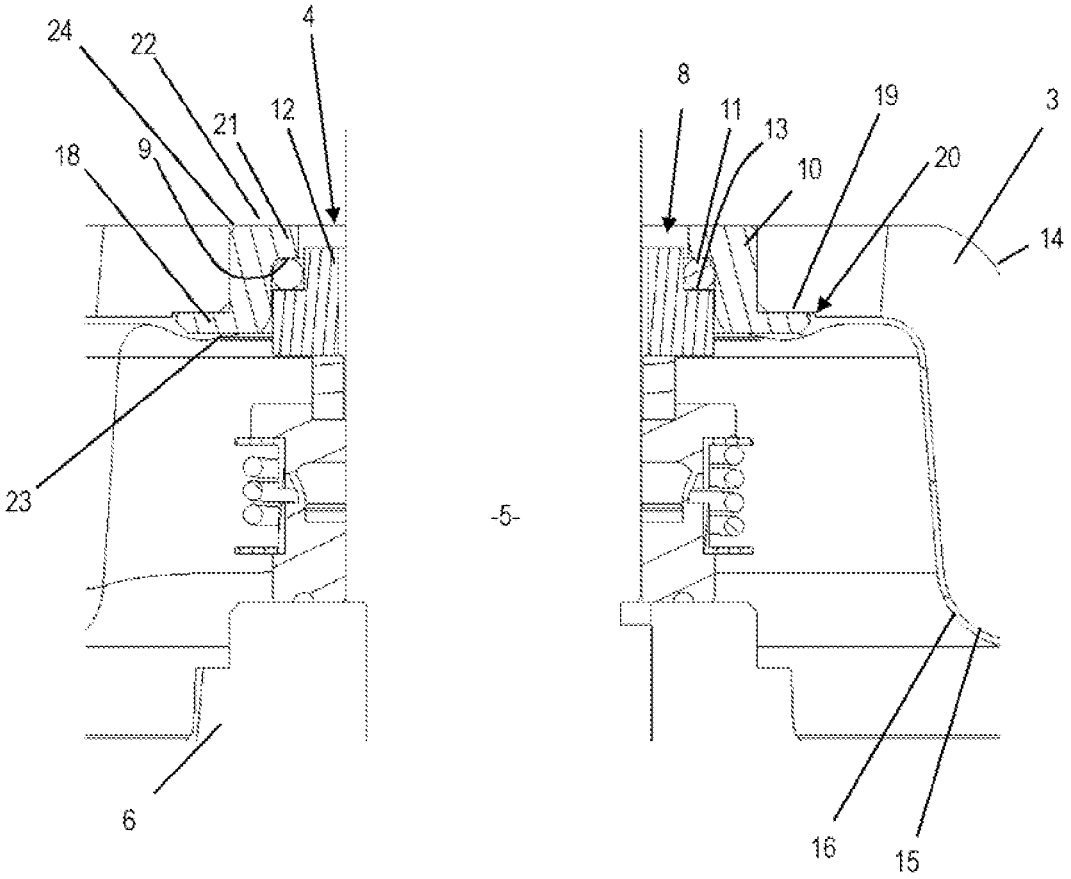
FIG. 2 shows a cut-out of a detail of the centrifugal pump in a cross-section.

In contrast to the illustration in FIG. 2, the outside 14 of the pump housing 2 can also be provided with a coating which then likewise extends over the transition between the rear wall 3 and the protector 10 so that a completely tight corrosion protection of the pump housing 3 is also ensured from the outside.

Figure 3:
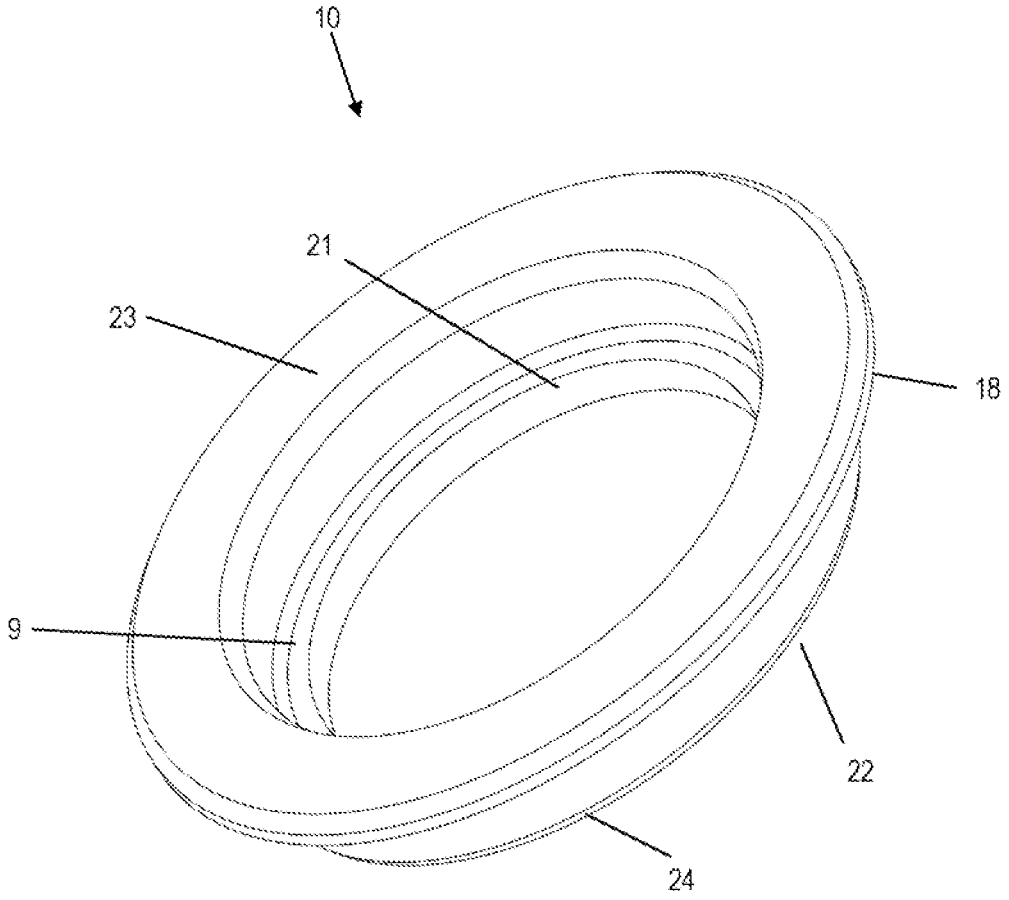
FIG. 3 shows a protector.

FIG. 3 shows the protector 10 in a spatial illustration. In this exemplary embodiment, the protector 10 is made as a ring of bronze, wherein in particular the seal seat 9 has a high accuracy of fit. For easier insertion of the protector 10 into the shaft passage 4, the front side 22, which faces toward the outside 14 and is inserted first into the shaft passage 4, is provided with a lead-in chamfer 24. The protector 10 can be made oversized with respect to the shaft passage 4 and can be held in the shaft passage 4 by means of interference fit, thus by means of a frictional connection. The axial position is then defined by the support flange 18 abutting against the support surface 19 of the rear wall 3.

The protector can be used not only for pumps, but also for other coated components for forming a stationary seal seat for a mechanical seal arrangement. The protector provides a secure solution for inserting a corrosion-resistant seal seat into a coated component, such as a centrifugal pump, without interrupting a corrosion protection of the pump housing or the coated component. At the same time, the protector provides a seal seat that is free from corrosion and, accordingly, can be used for a variety of applications. The pump or the pump housing/the pump rear wall is protected against corrosion by the protector. At the same time, the protector provides stable guidance for the counter ring of the mechanical seal arrangement. This makes it possible to produce the pump housing from less corrosion-resistant material, for example from gray iron. The pump housing can then be completely coated, wherein the coating also covers a transition between the pump housing and the protector so as to prevent fluid from penetrating into a contact area between the protector and the pump housing. The result is a one hundred percent protection of the pump housing from corrosive fluids. Thus, all pump housing regions that come into contact with the fluid are coated or are protected by the protector. In addition, the protector provides a corrosion-protected seal seat that can be produced with high accuracy of fit. Thus, high accuracy of fit is also ensured after replacing the sealing ring so that leaks can be reliably avoided.

Overall, the protector therefore enables a pump that can be produced with little effort and from inexpensive materials and nevertheless provides good corrosion protection so that the pump can be used for pumping corrosive fluids such as, e.g., swimming pool water.

The invention is not limited to any one of the above-described embodiments, but can be modified in many different ways.

All features and advantages, including constructional details, spatial arrangements and method steps arising from the description, in themselves and also in many different combinations, can be essential for the invention.

REFERENCE LIST

1 Centrifugal pump
2 Pump housing
3 Rear wall
4 Shaft passage
5 Motor shaft
6 Pump impeller
7 Motor
8 Mechanical seal arrangement
9 Seal seat
10 Protector
11 Sealing ring
12 Counter ring
13 Counter sealing ring seat
14 Outside
15 Inside
16 Coating
17 Coating
18 Support flange
19 Support flange
20 Transition
21 Collar
22 Front side
23 Front side
24 Lead-in chamfer

The invention claimed is:

1. A pump with a pump housing (2), wherein a motor shaft (5), which is connected to a pump impeller (6) arranged in the pump housing (2), extends through a shaft passage (4) in a rear wall (3) of the pump housing (2) and is mounted in the rear wall (3) by means of a mechanical seal arrangement (8), characterized in that a seal seat (9) of the mechanical seal arrangement (8) is formed in a ring-shaped protector (10) that is made from a corrosion-resistant material and is fixedly arranged in the shaft passage (4) of the rear wall (3), wherein the mechanical seal arrangement (8) comprises a sealing ring (11) and a counter ring (12) with a counter sealing ring seat (13), wherein the counter ring (12) is connected to the motor shaft (5) in a rotationally fixed manner, and the sealing ring (11) is arranged between the seal seat (9) and the counter sealing ring seat (13).

2. The pump according to claim 1, characterized in that the pump housing (2) is designed as a casting.

3. The pump according to claim 1, characterized in that the pump housing (2) has a corrosion-resistant coating (16, 17), wherein the coating (16) covers a transition (20) between the rear wall (3) and the protector (10).

4. The pump according to claim 1, characterized in that the protector has (10) has a radially outward facing, circumferential support flange (18) which is arranged on a front side (23) that faces toward the pump impeller (6) and by means of which the protector (10) is supported on the rear wall (3) in an axial direction.

5. The pump according to claim 4, characterized in that on an inside (15), the rear wall (3) comprises a stepped support region (19) for the support flange (18) that extends farther in the radial direction than the support flange (18).

6. The pump according to claim 1, characterized in that an inner border of the shaft passage (4) is chamfered.

7. The pump according to claim 1, characterized in that the seal seat (9) is formed by a radially inward protruding circumferential collar (21) on a front side (22) of the protector (10), which front side faces away from the pump impeller (6).

8. The pump according to claim 1, characterized in that the protector is (10) is pressed into the shaft passage (4) or is glued therein, or is held in the shaft passage (4) via mating threads.

9. The pump according to claim 1, characterized in that the protector (10) comprises a bronze material.

10. The pump according to claim 1, wherein the pump housing (2) is a gray iron casting.

11. The pump according to claim 1, wherein the pump is a centrifugal pump.

12. A protector (10) for a pump, which protector is formed in a ring-shaped manner from a corrosion-resistant material, and which has a radially outward projecting supporting flange (18) on a first front side (23), and on a second front side (22), the protector has a radially inward projecting collar (21) that forms a seal seat (9).

13. The pump according to claim 12, wherein the pump is a centrifugal pump.

14. The protector of claim 12, wherein the corrosion resistant material is a bronze material.

15. A pump comprising a pump housing (2), wherein a motor shaft (5), which is connected to a pump impeller (6) arranged in the pump housing (2), extends through a shaft passage (4) in a rear wall (3) of the pump housing (2) and is mounted in the rear wall (3) by means of a mechanical seal arrangement (8), characterized in that a seal seat (9) of the mechanical seal arrangement (8) is formed in a ring-shaped protector (10) that is made from a corrosion-resistant material and is fixedly arranged in the shaft passage (4) of the rear wall (3), the ring-shaped protector formed from a corrosion resistant material and having a radially outward projecting supporting flange (18) on a first front side (23), and on a second front side (22), the ring-shaped protector has a radially inward projecting collar (21) that forms the seal seat (9).

16. The pump according to claim 15, wherein the mechanical seal arrangement (8) comprises a sealing ring (11) and a counter ring (12) with a counter sealing ring seat (13), wherein the counter ring (12) is connected to the motor shaft (5) in a rotationally fixed manner, and the sealing ring (11) is arranged between the seal seat (9) and the counter sealing ring seat (13).

17. The pump according to claim 15, wherein the pump is a centrifugal pump.

18. The pump according to claim 15, wherein the pump housing (2) is a gray iron casting.

19. The pump of claim 15, wherein the corrosion resistant material is a bronze material.

* * * * *